US012782061B2

(12) United States Patent
Kosamana et al.

(10) Patent No.: US 12,782,061 B2
(45) Date of Patent: Nov. 3, 2026

(54) SYSTEM FOR STORING AND USING THERMAL ENERGY

(71) Applicant: NUOVO PIGNONE TECNOLOGIE—S.R.L., Florence (IT)

(72) Inventors: Bhaskara Kosamana, Karnataka (IN); Rajesh Mavuri, Karnataka (IN)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 109 days.

(21) Appl. No.: 18/716,351

(22) PCT Filed: Dec. 6, 2022

(86) PCT No.: PCT/EP2022/025554

§ 371 (c)(1),
(2) Date: Jun. 4, 2024

(87) PCT Pub. No.: WO2023/104333

PCT Pub. Date: Jun. 15, 2023

(65) Prior Publication Data

US 2025/0035386 A1 Jan. 30, 2025

(30) Foreign Application Priority Data

Dec. 9, 2021 (IT) ..... 102021000030965

(51) Int. Cl.
*F28D 20/00* (2006.01)

(52) U.S. Cl.
CPC ..... *F28D 20/0034* (2013.01)

(58) Field of Classification Search
CPC ..... F28D 20/0034; F28D 2020/006; F28D 2020/0078; F28D 2020/0082; F01K 3/12; Y02E 60/14
See application file for complete search history.

(56) References Cited

U.S. PATENT DOCUMENTS 5,127,470 A * 7/1992 Inaba ..... F28D 20/003 62/480
5,537,822 A 7/1996 Shnaid et al.
(Continued)

FOREIGN PATENT DOCUMENTS

DE 10 2019 127431 A1 4/2021
EP 2 312 129 A1 4/2011
(Continued)

OTHER PUBLICATIONS

Benato, et al., "Pumped Thermal Electricity Storage: A technology overview".
(Continued)

*Primary Examiner* — Travis Ruby
(74) *Attorney, Agent, or Firm* — Paul Frank + Collins P.C.

(57) ABSTRACT

The system for storing and using thermal energy has a first closed-loop cycle arrangement which comprises two main storage tanks: a first tank to store heat-storage fluid at low temperature and a second tank to store heat-storage fluid at high temperature. The system comprises also a second thermodynamic cycle arrangement and a third thermodynamic cycle arrangement which can work respectively as a heat pump, to heat in a first heat exchanger the heat-storage fluid at low temperature by consuming electrical energy and store it in the second tank, and as a heat engine, to produce electrical energy by cooling in a second heat exchanger the heat-storage fluid at high temperature and store it in the first tank.

13 Claims, 6 Drawing Sheets

(56) References Cited

U.S. PATENT DOCUMENTS

| | | | | |
|---|---|---|---|---|
| 9,845,998 | B2 | 12/2017 | Kreuger | |
| 9,938,896 | B2 | 4/2018 | Bannari | |
| 9,951,979 | B2 | 4/2018 | Aga et al. | |
| 10,443,452 | B2 | 10/2019 | Laughlin et al. | |
| 10,584,634 | B2 | 3/2020 | Kosamana et al. | |
| 11,162,387 | B1 * | 11/2021 | McCormick | F25B 27/005 |
| 2014/0060051 | A1 | 3/2014 | Ohler et al. | |
| 2018/0187597 | A1 | 7/2018 | Apte et al. | |
| 2022/0049616 | A1 * | 2/2022 | Truong | F01K 27/02 |
| 2025/0116211 | A1 * | 4/2025 | Truong | F01K 3/12 |

FOREIGN PATENT DOCUMENTS

| | | | |
|---|---|---|---|
| EP | 2602443 | A1 | 6/2013 |
| WO | 2015091329 | A1 | 6/2015 |

OTHER PUBLICATIONS

Frate, et al., "Multi-criteria investigation of a pumped thermal electricity storage (PTES) system with thermal integration and sensible heat storage".

Peterson, "A concept for storing utility-scale electrical energy in the form of latent heat".

Eppinger, et al., "Pumped thermal energy storage with heatpump-ORC-systems: Comparison of latentand sensible thermal storages for variousfluids", Dec. 15, 2020.

Liu, "Development of a novel cogeneration system by combing organic rankine cycle and heat pump cycle for waste heat recovery", Feb. 15, 2021.

Steger, et al., "Design aspects of a reversible heat pump—Organic rankine cycle pilot plant for energystorage", Oct. 1, 2020.

* cited by examiner

SYSTEM FOR STORING AND USING THERMAL ENERGY

TECHNICAL FIELD

The subject-matter disclosed herein relates to systems for storing thermal energy and afterwards using the stored thermal energy to generate electrical energy.

BACKGROUND ART

In order to mitigate climate change impacts, one of the global trends is to replace non-renewable sources, such as fossil fuels, with renewable sources, such as solar and wind power. However, renewable sources have the disadvantage to be intermittent sources and therefore not always available for the production of electrical energy.

Energy storage is seen as an enabling technology with the potential to reduce the intermittency and variability of renewable sources. Using energy storage, the energy is stored when excess power is available (i.e. when electrical energy demand is lower than electrical energy production) and used when energy is needed (i.e. when electrical energy production is needed but the energy source is not available or is insufficiently available).

From patent document U.S. Pat. No. 10,443,452B2 there is known a pumped thermal energy storage system comprising a compressor, a turbine and two counterflow heat exchangers, each one being fluidly coupled to a thermal storage made by two tanks, a first tank storing high-temperature storage fluid and a second tank storing low-temperature storage fluid. The pumped thermal energy storage system can store energy by operating as a heat pump and extract energy by operating as a heat engine. When the system stores energy, a first heat exchanger receives low-temperature storage fluid from a first tank and heats it, so that hot storage fluid exiting from the first heat exchanger is stored in a second tank, and a second heat exchanger receives high-temperature storage fluid from a third tank and cools it, so that cold storage fluid exiting from the second heat exchanger is stored in a fourth tank. When the system extract energy, the first heat exchanger receives high-temperature storage fluid from the first tank and cools it, so that cold storage fluid exiting from the first heat exchanger is stored in the second tank, and the second heat exchanger receives cold storage fluid from the third tank and heats it, so that hot storage fluid exiting from the second heat exchanger is stored in the fourth tank.

SUMMARY

It would be desirable to have a storage thermal energy system which is simple and efficient; a small footprint would also be desirable.

According to an aspect, the subject-matter disclosed herein relates to a system for storing and using thermal energy which has two storage tanks, a first tank to store heat-storage fluid at low temperature and a second tank to store heat-storage fluid at high temperature. The system may work alternatively in a first operating condition, i.e. as a heat pump, to heat the heat-storage fluid at low temperature by consuming electrical energy and store it in the second tank and in a second operating condition, i.e. as a heat engine, to produce electrical energy by cooling the heat-storage fluid at high temperature and store it in the first tank.

Advantageously, the system comprises two heat exchangers, in particular a condenser and an evaporator; the condenser is configured to transfer heat from a working fluid to the heat-storage fluid when the system works as a heat pump and to an external fluid stream, for example ambient air, when the system works as a heat engine and the evaporator is configured to transfer heat from the heat-storage fluid to a working fluid when the system works as a heat engine and to an external fluid stream, for example ambient air, when the system works as a heat pump.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
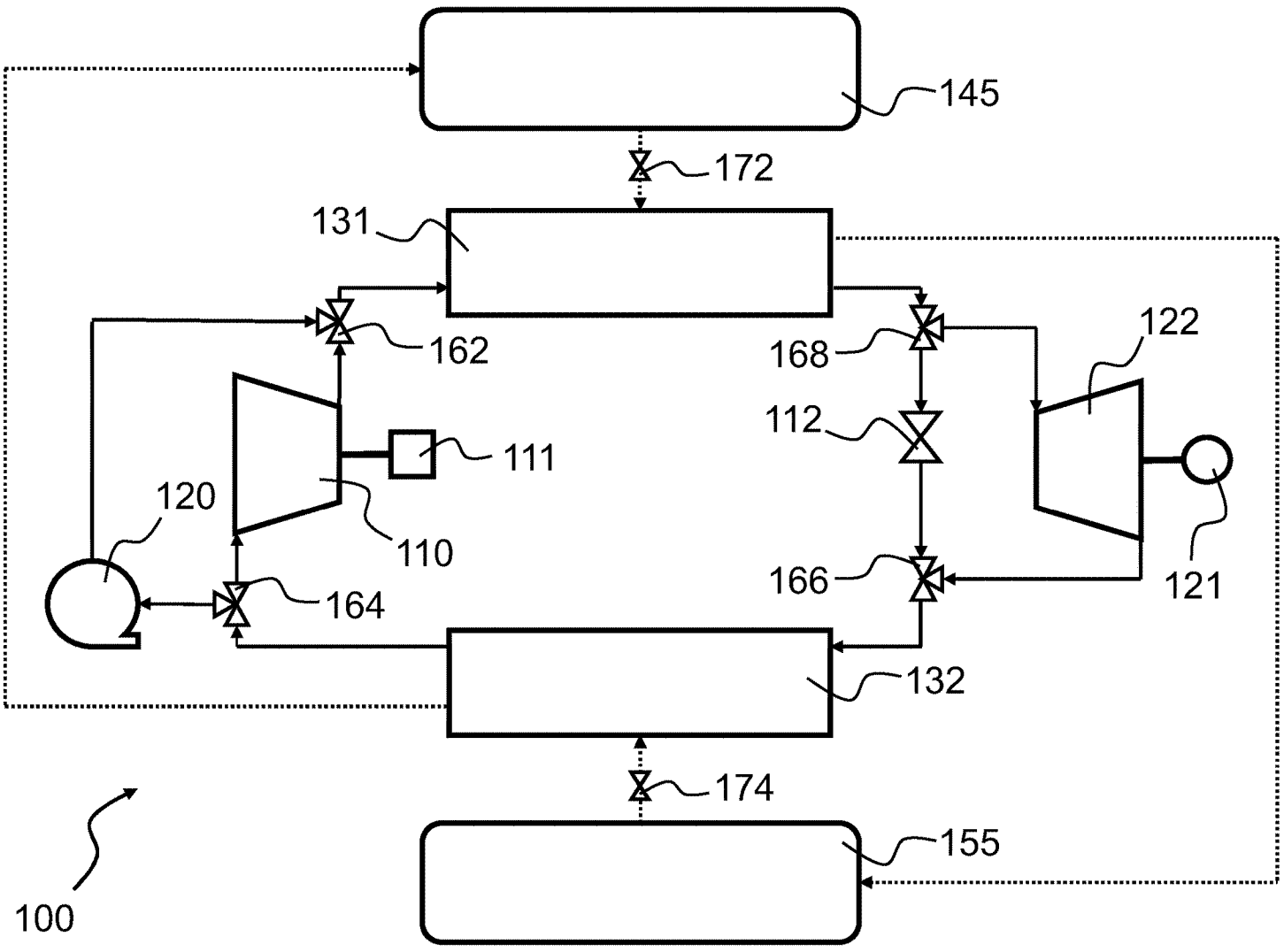
FIG. 1 shows a simplified diagram of a first embodiment of a system for storing and using thermal energy.

According to an aspect, the subject-matter disclosed herein relates to a system for storing and using thermal energy which can work alternatively in two different operation conditions: as a heat pump (or charging condition), consuming electrical energy to heat and store heat-storage fluid at high temperature in a second tank, and as a heat motor (or discharging condition), generating electrical energy by using the heat-storage fluid from the second tank, cooling and storing heat-storage fluid at low temperature in a first tank. The first tank and the second tank are both fluidly coupled to a first or a second heat exchanger depending on the operation condition of the system: a first heat exchanger, which works as a condenser, is arranged to transfer heat to the heat-storage fluid flowing from the first tank to the second tank in the charging condition and a second heat exchanger, which works as an evaporator, is arranged to transfer heat from the heat-storage fluid flowing from the second tank to the first tank in the discharging condition. Advantageously, the system works in the charging condition when excess power is available and in the discharging condition when energy is needed.

Reference now will be made in detail to embodiments of the disclosure, an example of which is illustrated in the drawings. The example is provided by way of explanation of the disclosure, not limitation of the disclosure. In fact, it will be apparent to those skilled in the art that various modifications and variations can be made in the present disclosure without departing from the scope or spirit of the disclosure. In the following description, similar reference numerals are used for the illustration of figures of the embodiments to indicate elements performing the same or similar functions. Moreover, for clarity of illustration, some references may be not repeated in all the figures.

In FIG. 1 there is schematically shown a diagram of a first embodiment of a system for storing and using thermal energy generally indicated with reference numeral 100. The system 100 comprises a first closed-loop arrangement (see the dotted line in FIG. 1) comprising a first tank 145 and a second tank 155. The first tank 145 and the second tank 155 are arranged to store a heat-storage fluid, in particular the same heat-storage fluid: the first tank 145 is arranged to store heat-storage fluid at a first temperature, in particular a low temperature, and the second tank 155 is arranged to store heat-storage fluid at a second temperature, in particular a high temperature. In other words, the second temperature is higher than the first temperature. For example, the first temperature could be around 120° C. (more generally in the exemplary range 80-200° C.) and the second temperature could be around 400° C. (more generally in the exemplary range 200-600° C.). Preferably, heat-storage fluid of the first tank 145 and heat-storage fluid of the second tank 155 are the same fluid, for example diathermic oil, heavy oil such as Theminol VP-1 or Dowtherm A, molten salt, such as sodium nitrate (NaNO3) or potassium nitrate (KNO3), or a mixture of molten salts.

Figure 2:
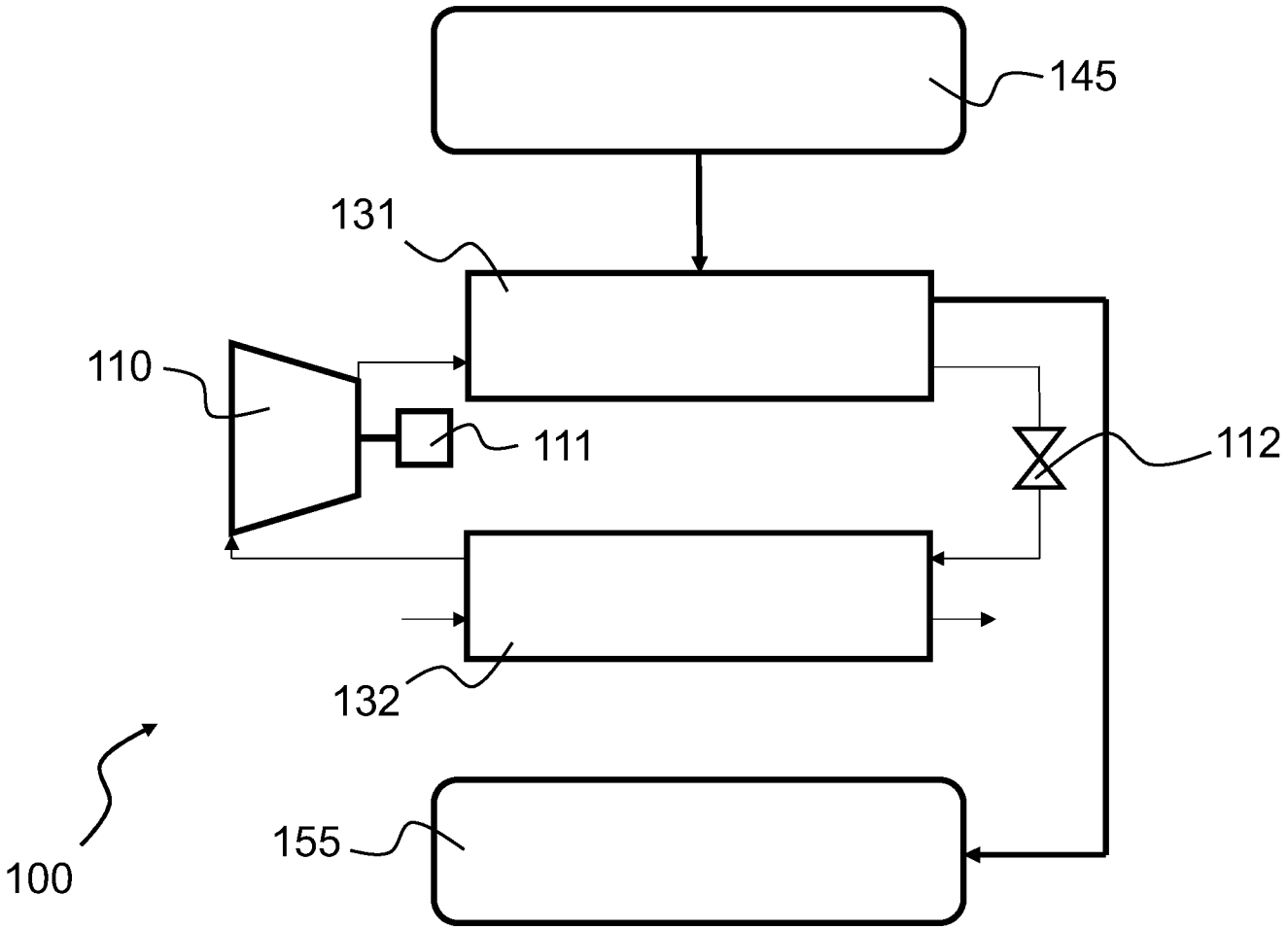
FIG. 2 shows the system of FIG. 1 in a first operating condition (charge cycle)
Figure 3:
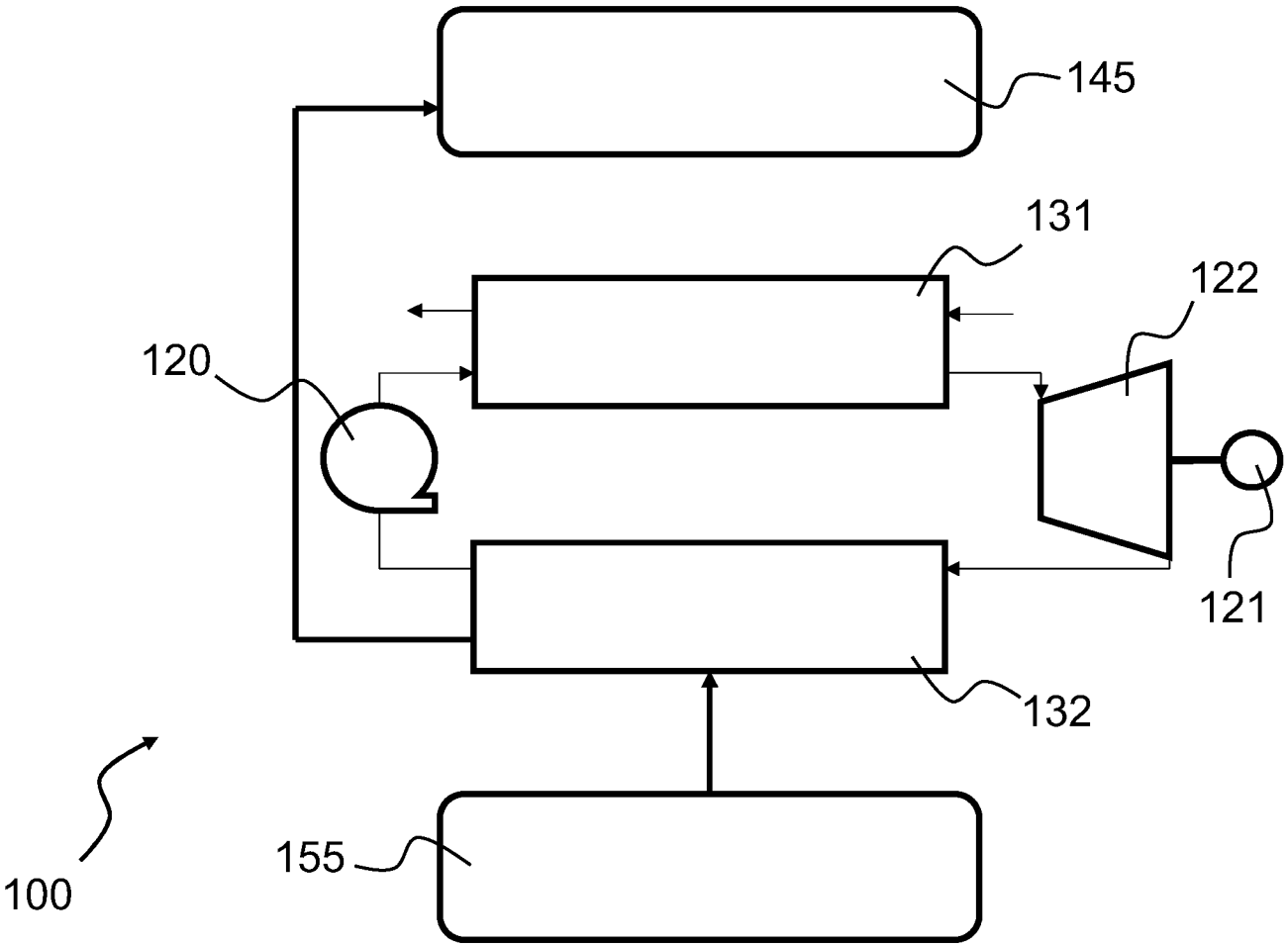
FIG. 3 shows the system of FIG. 1 in a second operating condition (discharge cycle)

As it will be apparent from the following, the first closed-loop cycle arrangement is configured to flow heat-storage fluid from the first tank 145 to the second tank 155 in a first operating condition (see for example FIG. 2) and to flow heat-storage fluid from the second tank 155 to the first tank 145 in a second operating condition (see for example FIG. 3). In particular, when the closed-loop cycle works in the first operating condition, the system 100 consumes electrical energy to store hot heat-storage fluid in the second tank 155 and when the closed-loop cycle works in the second operating condition, the system 100 generates electrical energy by using the hot heat-storage fluid of the second tank 155.

The first closed-loop cycle arrangement may comprise further a first valve 172 and a second valve 174 configured to switch alternatively between an open configuration and a closed configuration. In particular, when the first valve 172 is in the open configuration, the heat-storage fluid of the first closed-loop cycle arrangement can fluid from the first tank 145 to the second tank 155, and when the second valve 174 is in the open configuration, the heat-storage fluid of the first closed-loop cycle arrangement can fluid from the second tank 155 to the first tank 145. Preferably, when the first valve 172 is in the open configuration, the second valve 174 is in the closed configuration and when the second valve 174 is in the open configuration, the first valve 172 is in the closed configuration. In other words, when the first valve 172 is in the open configuration and the second valve 174 is in the closed configuration then the first closed-loop cycle arrangement is in the first operating condition, and when the first valve 172 is in the closed configuration and the second valve 174 is in the open configuration then the first closed-loop cycle arrangement is in the second operating condition.

Advantageously, the first tank 145 and the second tank 155 comprise two or more sections to store the heat-storage fluid. In particular, each section of the first tank 145, as well as each section of the second tank 155, may be fluidly decoupled (i.e. each section is independent), so that each section of the first tank 145, as well as each section of the second tank 155, may be charged/discharged with a partial amount of heat-storage fluid with respect to the total amount of heat-storage fluid circulating in the first closed-loop arrangement. It is to be noted that 8 of the first tank 145 and each section of the second tank 155 may be configured to store different partial amounts of heat-storage fluid or the same partial amount. Advantageously, as it will better explained in the following, the charging/discharging of each section is controlled by a control system (not shown in any figures). As a non-limiting example, the control unit could be a computer, programmable controller, microprocessor or similar device.

In particular, each section of the first tank 145 may be fluidly coupled to each section of the second tank 155, for example through a dedicated pipe. As a non-limiting example, when the system 100 works in the first operating condition (charge cycle), the heat-storage fluid flows from a first section of the first tank 145 to a first section of the second tank 155 (exchanging heat during the flowing, as it will better explained in the following). In particular the first tank 145 and the second tank 155 may be fluidly coupled through at least one pipe. Advantageously, each end of the pipe is provided with a multiway valve having a plurality of ports, each port being fluidly coupled to a different section of the respective tank 145 and 155 so that, for example, a first section of the first tank 145 and a first section of the second tank 155 may be charged/discharged independently from the other sections of the tanks 145 and 155. In particular, the control system may control the operation of the multiway valve in order to control which section of the first tank 145 and which section of the second tank 155 are fluidly coupled.

According to the embodiment of FIG. 1, system 100 comprises further any or both of:

- a second thermodynamic cycle arrangement configured to heat the heat-storage fluid flowing from the first tank 145 to the second tank 155 by consuming first electrical energy, the electrical energy being input to the system 100, and
- a third thermodynamic cycle arrangement configured to produce second electrical energy by cooling the heat-storage fluid flowing from the second tank 155 to the first tank 145, the second electrical energy being output from the system 100.

In other words, the second thermodynamic cycle arrangement is configured to work when the first closed-loop cycle arrangement is in the first operating condition (see for example FIG. 2) and the third thermodynamic cycle arrangement is configured to work when the first closed-loop cycle arrangement is in the second operating condition (see for example FIG. 3).

The second thermodynamic cycle arrangement may be arranged to circulate a first working fluid; in particular, the first working fluid is pentafluoroethane or pentafluoropropane or carbon dioxide or cyclopentane.

The third thermodynamic cycle arrangement may be arranged to circulate a second working fluid; in particular, the first working fluid is pentafluoroethane or pentafluoropropane or carbon dioxide or cyclopentane.

Preferably, according to the preferred embodiment shown in FIG. 1, the second thermodynamic cycle arrangement and the third thermodynamic cycle arrangement are arranged to circulate the same working fluid.

Advantageously, with non-limiting reference to FIG. 1, the second thermodynamic cycle arrangement and the third thermodynamic cycle arrangement are fluidly coupled. In particular, the second thermodynamic cycle arrangement and the third thermodynamic cycle arrangement share a valve arrangement which comprises three-way valves 162, 164, 166, 168 (see for example the four three-way valves in FIG. 1).

The three-way valves 162, 164, 166, 168 are arranged to switch the first closed-loop cycle arrangement between the first operating condition and the second operating condition; in particular, the three-way valves 162, 164, 166, 168 are arranged to deviate the first or second working fluid to flow in at least a portion of the second thermodynamic cycle arrangement or at least a portion of the third thermodynamic cycle arrangement. For example, in the first operating condition shown in FIG. 2, the three-way valves 162, 164, 166, 168 are arranged so that the working fluid is deviated to flow in the second thermodynamic cycle arrangement and in the second operating condition shown in FIG. 3, the three-way valves 162, 164, 166, 168 are arranged so that the working fluid is deviated to flow in the third thermodynamic cycle arrangement.

The system 100 comprises a first heat exchanger 131, in particular a condenser, configured to be fluidly coupled to the first tank 145 and the second tank 155 when the first closed-loop arrangement is in the first operating condition and a second heat exchanger 132, in particular an evaporator, configured to be fluidly coupled to the first tank 145 and the second tank 155 when the first closed-loop arrangement is in the second operating condition. It is to be noted that the second thermodynamic cycle arrangement comprises the first heat exchanger 131 and the third thermodynamic cycle arrangement comprises the second heat exchanger 132; however, as it will be better described in the following, the second thermodynamic cycle arrangement and the third thermodynamic cycle arrangement may share the first heat exchanger 131 and the second heat exchanger 132. Advantageously, during each operating condition, only one heat exchanger 131 or 132 of the system 100 is fluidly coupled to the first and the second tank 145 and 155. Preferably, a valve 172 is located between the first tank 145 and the first heat exchanger 131 and a valve 174 is located between the second tank 155 and the second heat exchanger 132, the valves 172, 174 being arranged to switch between an open configuration and a closed configuration. Preferably, when the first closed-loop arrangement is in the first operating condition the valve 172 is in the open configuration and the valve 174 is in the closed configuration (see for example FIG. 2) and when the first closed-loop arrangement is in the second operating condition the valve 172 is in the closed configuration and the valve 174 is in the open configuration (see for example FIG. 3).

Advantageously, with non-limiting reference to FIG. 2, when the first closed-loop arrangement is in the first operating condition, the heat-storage fluid can flow from the first tank 145 to the first heat exchanger 131, the first heat exchanger 131 being configured to transfer heat from the second thermodynamic cycle arrangement to the first closed-loop arrangement, in particular from the first working fluid circulating in the second thermodynamic cycle arrangement to the heat-storage fluid of the first closed-loop arrangement; then the hot heat-storage fluid can flow from the first heat exchanger 131 to the second tank 155 and being stored in the second tank 155.

Advantageously, with non-limiting reference to FIG. 3, when the first closed-loop arrangement is in the second operating condition, the heat-storage fluid can flow from the second tank 155 to the second heat exchanger 132, the second heat exchanger 132 being configured to transfer heat from the first closed-loop arrangement to the third thermodynamic cycle arrangement, in particular from the heat-storage fluid of the first closed-loop arrangement to the second working fluid circulating the third thermodynamic cycle arrangement; then the cold heat-storage fluid can flow from the second heat exchanger 132 to the first tank 145 and being stored in the first tank 145.

It is to be noted that, according to the preferred embodiment shown in FIG. 1, the second thermodynamic cycle arrangement and the third thermodynamic cycle arrangement may share the first heat exchanger 131 and the second heat exchanger 132. Advantageously, with non-limiting reference to FIG. 2, when the first closed-loop cycle arrangement is in the first operating condition, the second heat exchanger 132 is configured to receive a first fluid stream, to transfer heat to the second thermodynamic cycle arrangement and to discharge the first fluid stream. Preferably, the first fluid stream is ambient air (or water). Advantageously, with non-limiting reference to FIG. 3, when the first closed-loop cycle arrangement is in the second operating condition, the first heat exchanger 131 is configured to receive a second fluid stream, to transfer heat from the third thermodynamic cycle arrangement and to discharge the second fluid stream. Preferably, the second fluid stream is ambient air (or water).

Advantageously, according to the preferred embodiment shown in FIG. 1, the second thermodynamic cycle arrangement comprises further a compressor 110 configured to generate a pressure increase upstream the heating of the heat-storage fluid, in particular upstream the first heat exchanger 131, and a throttle valve 112 configured to generate a pressure drop downstream the heating of the heat-storage fluid, in particular downstream the first heat exchanger 131. Preferably, the compressor 110 is configured to be mechanically couplable to an electric motor 111 arranged to consume the first electrical energy and transform electrical energy into mechanical energy, in particular to drive the compressor 110 during the first operating condition of the first closed-loop cycle arrangement.

Advantageously, according to the preferred embodiment shown in FIG. 1, the third thermodynamic cycle arrangement comprises further a pump 120 configured to generate a pressure increase downstream the cooling of the heat-storage fluid, in particular downstream the second heat exchanger 132, and an expander 122 configured to generate a pressure drop upstream the cooling of the heat-storage fluid, in particular upstream the second heat exchanger 132. Preferably, the expander 122 is configured to be mechanically couplable to an electric generator 121 arranged to transform mechanical energy into electrical energy and to produce the second electrical energy during the second operating condition of the first closed-loop cycle arrangement.

Preferably, the pump 120 may be coupled to a variable speed motor, not shown in the figure, which is the driver of the pump 120; advantageously, by varying the rotation speed of the pump 120, the flow and/or pressure of the first working fluid may be adjusted and therefore the second electrical energy, which is outlet from the system 100, may be regulated, for example to follow the energy requirements. Advantageously, the expander 122 is equipped with nozzle guide vanes (=NGV), not shown in the figure. configured to modify the vane angle of the first stages of the expander 122 when the pump 120 rotated at a different speed with respect to nominal speed; advantageously, by optimizing the vane angle of the first stages of the expander 122 the efficiency of the expander 122 is kept high.

A second embodiment 200 of a system for storing and using thermal energy will be described in the following with the aid of FIG. 4. It is to be noted that elements 210, 211, 212, 220, 221, 222, 231, 232, 245, 255, 272 and 274 in FIG. 4 may be identical or similar respectively to elements 110 (compressor), 111 (electric motor), 112 (throttle valve), 120 (pump), 121 (electric generator), 122 (expander), 131 (first heat exchanger), 132 (second heat exchanger), 145 (first tank), 155 (second tank), 172 (valve) and 174 (valve) in FIG. 1 and perform the same or similar functions.

Figure 4:
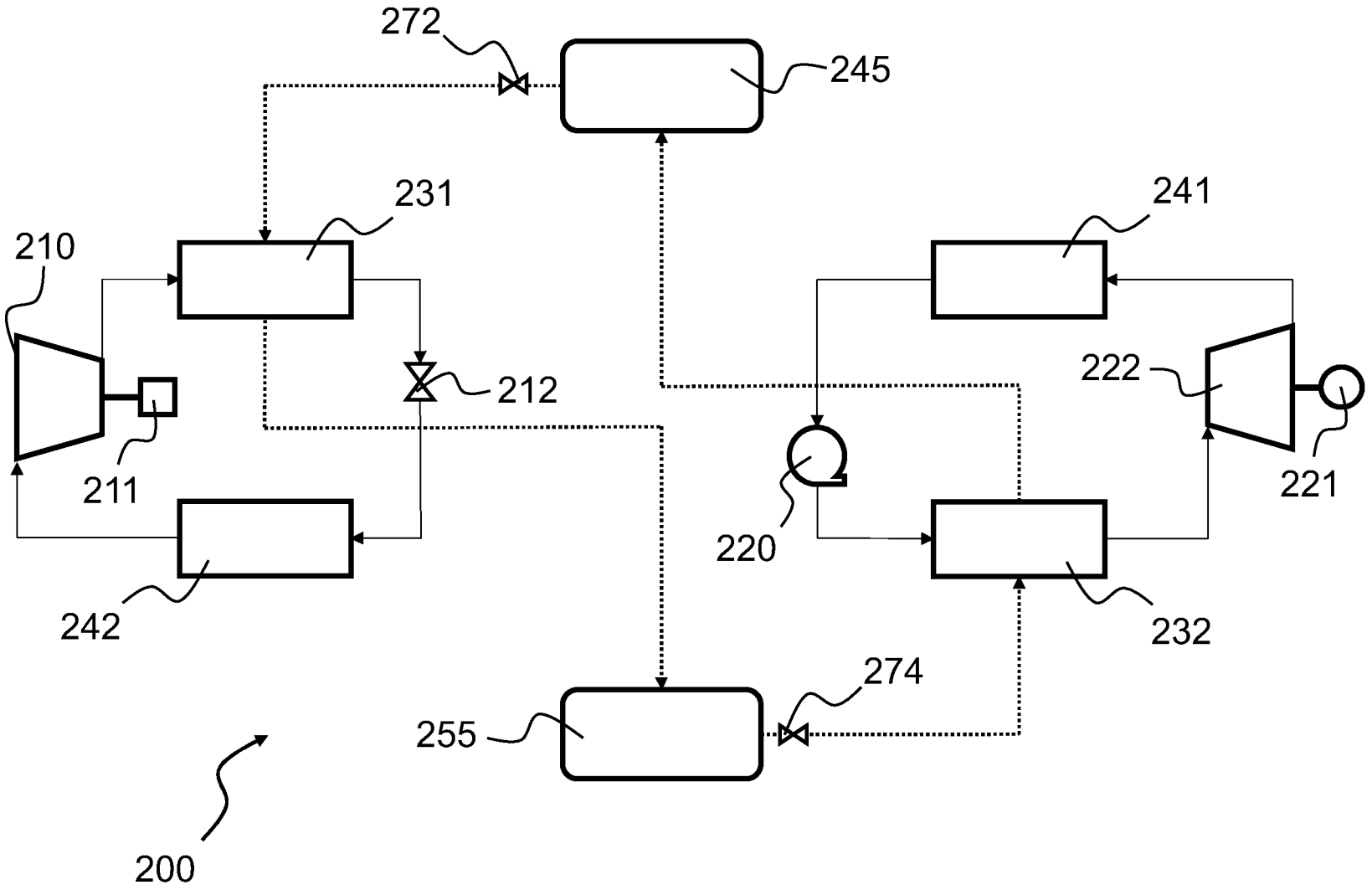
FIG. 4 shows a simplified diagram of a second embodiment of a system for storing and using thermal energy.

It is to be noted that the system 200 of FIG. 4 is similar to the system 100 of FIG. 1. However, the system 200 of FIG. 4 differs from the system 100 of FIG. 1 in that the second thermodynamic cycle arrangement and the third thermodynamic cycle arrangement are not fluidly coupled and does not share any heat exchanger 231, 232. Due to that, the first working fluid that circulates in the second thermodynamic cycle arrangement and the second working fluid that circulates in the third thermodynamic cycle arrangement are distinct and advantageously different.

Preferably, the system 200 comprises further a third heat exchanger 242, in particular an evaporator, fluidly coupled to the second thermodynamic cycle arrangement, and a fourth heat exchanger 241, in particular a condenser, fluidly coupled to the third thermodynamic cycle arrangement. Advantageously, the third heat exchanger 242 is fluidly coupled to a third fluid stream and is configured to transfer heat from the third fluid stream to the second closed-loop cycle arrangement when the first closed-loop cycle arrangement is in the first operating condition. Preferably, the third fluid stream is ambient air. Advantageously, the fourth heat exchanger 241 is fluidly coupled to a fourth fluid stream and is configured to transfer heat from the third closed-loop cycle arrangement to the fourth fluid stream when the first closed-loop cycle arrangement is in the second operating condition. Preferably, the fourth fluid stream is ambient air.

Figure 5:
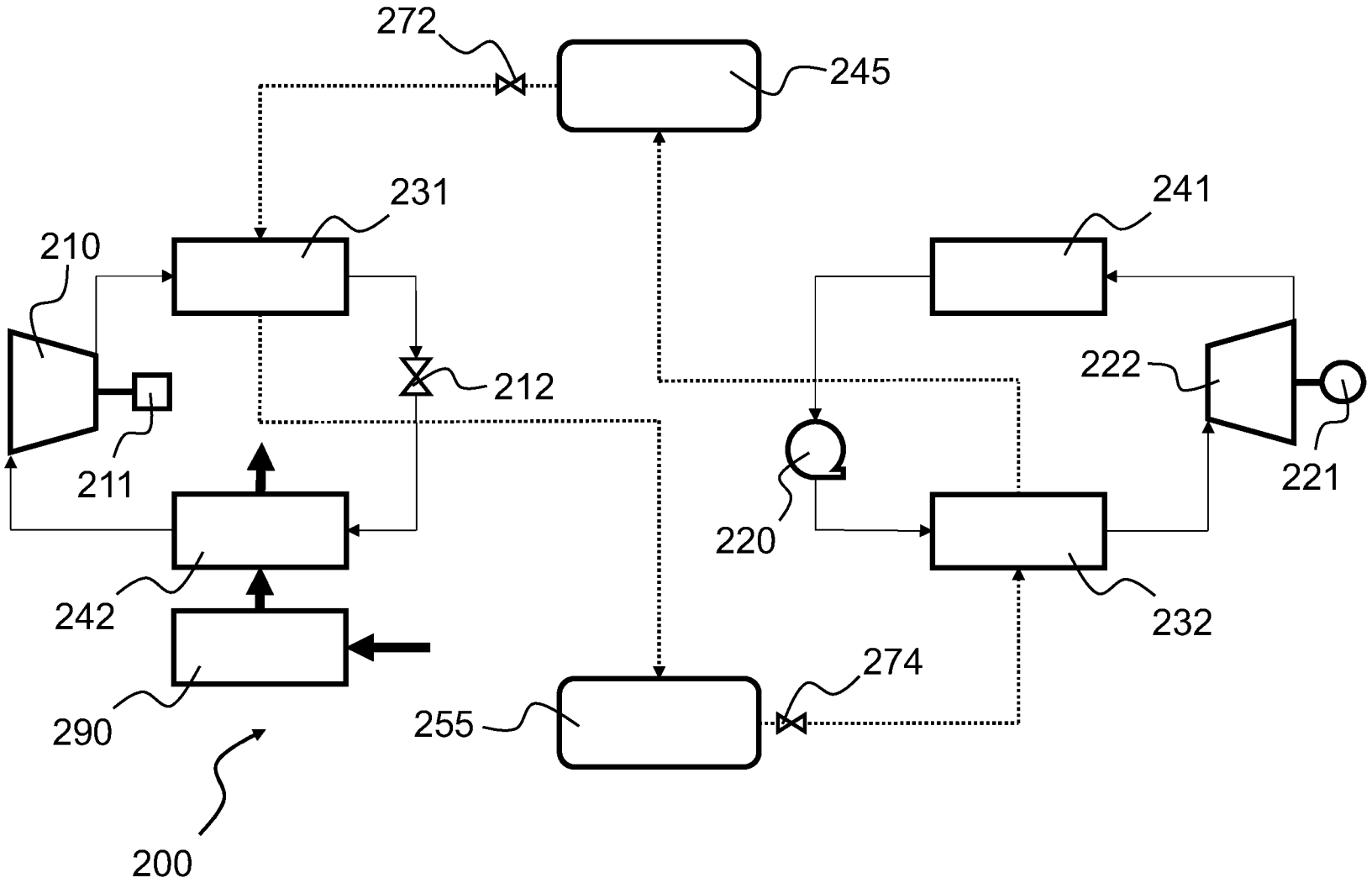
FIG. 5 shows a simplified diagram of the system of FIG. 4 with an additional heat unit.

System 200 may comprise further a heat unit 290 configured to be fluidly coupled to the third heat exchanger 242 (see for example the variant of system 200 shown in FIG. 5). Advantageously, the heat unit 290 is configured to transfer heat to the third fluid stream when the first closed loop arrangement is in the first operating condition. The heat unit 290 is for example a solar unit or a geothermal unit or a waste heat recovery unit. In particular, the third fluid stream, preferably ambient air (or water), passes through the heat unit 290 and is heated by the heat unit 290, is sent to the third heat exchanger 242 and transfer heat to the second closed-loop cycle arrangement, in particular to the first working fluid circulating in the second closed-loop cycle arrangement, and finally the third fluid stream is discharged back in the ambient surrounding the third heat exchanger 242 (see the thick black arrows in FIG. 5).

Figure 6:
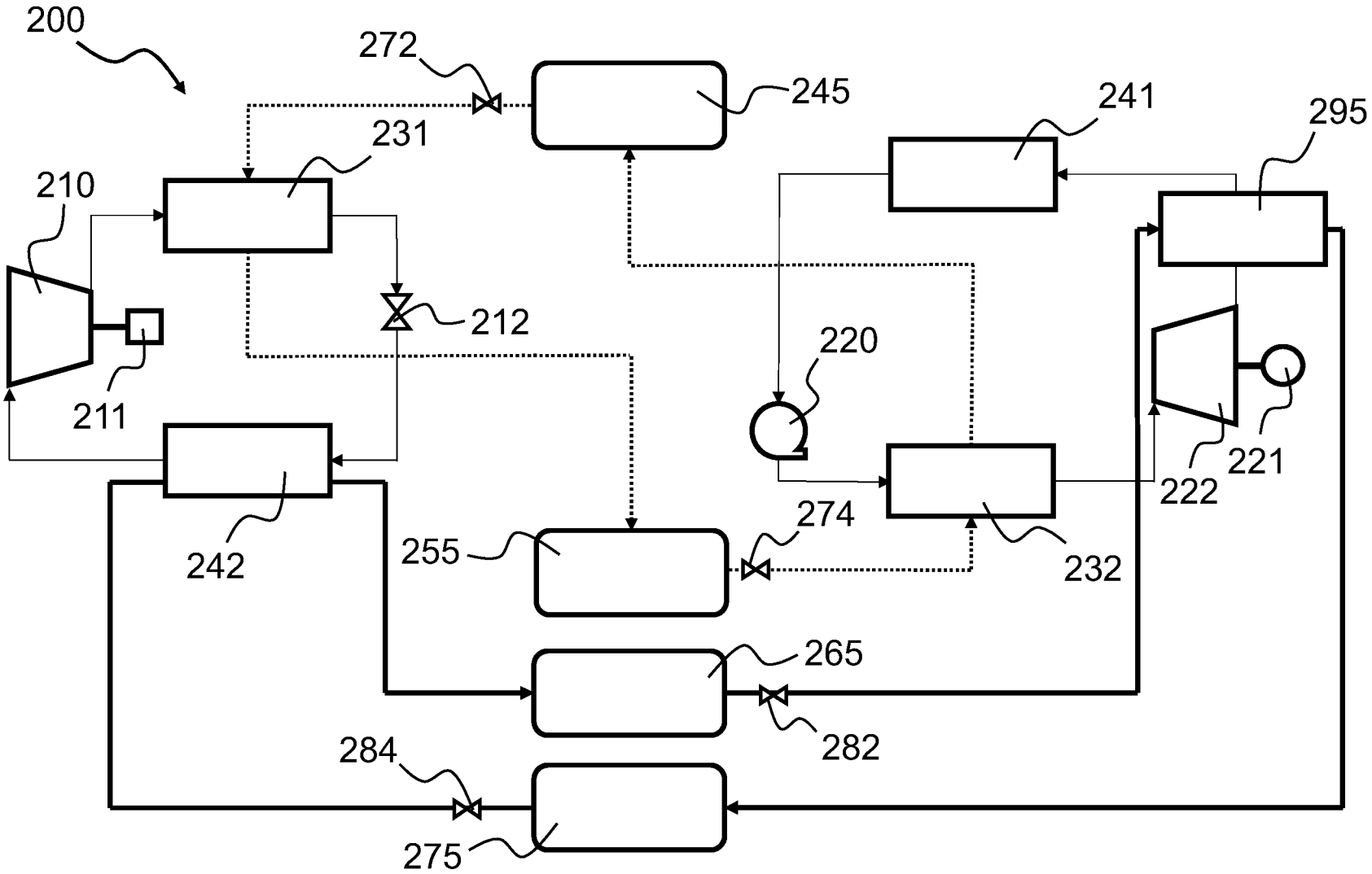
FIG. 6 shows a simplified diagram of the system of FIG. 4 with a second closed-loop cycle arrangement.

System 200 may comprise further a second closed loop cycle arrangement comprising a third tank 265 and a fourth tank 275 (see for example the variant of system 200 shown in FIG. 6). In particular, the third tank 265 is arranged to store second heat-storage fluid at a third temperature and the fourth tank is arranged to store second heat-storage fluid at a fourth temperature; advantageously, the fourth temperature is higher than the third temperature and lower than the second temperature; in other words, the fourth temperature is any temperature between the second temperature and the third temperature. For example, the fourth temperature could be around 200° C. to 550° C. and the third temperature could be around 80° C. to 180° C. It is to be noted that the second closed loop cycle arrangement of FIG. 6 is configured to recover part of residual heat of the second working fluid discharged from the expander 222 and use it in the heat exchanger 242, in particular as an alternative fluid to ambient air or water.

Advantageously, with non-limiting reference to FIG. 6, the second closed-loop cycle arrangement is configured to flow second heat-storage fluid from the fourth tank 275 to the third tank 265 in a first operating condition and to flow second heat-storage fluid from the third tank 265 to the fourth tank 275 in a second operating condition. Preferably, the second closed-loop cycle arrangement is in the first operating condition when the first closed-loop cycle arrangement is in the first operating condition and the second closed-loop cycle arrangement is in the second operating condition when the first closed-loop cycle arrangement is in the second operating condition. Preferably, heat-storage fluid of the third tank 265 and heat-storage fluid of the fourth tank 275 are the same fluid. It is to be noted that the first heat-storage fluid and the second heat-storage fluid may be the same fluid or different fluids.

Advantageously, with non-limiting reference to FIG. 6, the second closed-loop cycle arrangement comprises further a third valve 282 and a fourth valve 284. In particular, the circulation of second heat-storage fluid between the third tank 265 and the fourth tank 275 is regulated by the third valve 282 and the fourth valve 284, which are configured to switch alternatively between an open configuration and a closed configuration. Advantageously, when the second closed-loop cycle arrangement in the first operating condition, the third tank 265 and the fourth tank 275 are fluidly coupled to the third heat exchanger 242; in particular, when the second closed-loop cycle arrangement in the first operating condition, the third valve 282 is in the closed configuration and the fourth valve 284 is in the open configuration. Preferably, when the fourth valve 284 is in the open configuration, the first closed-loop cycle arrangement is in the first operating condition.

System 200 may comprise further a fifth heat exchanger 295 configured to transfer heat from the third thermodynamic cycle arrangement to the second closed-loop cycle arrangement. Advantageously, when the second closed-loop cycle arrangement in the second operating condition, the third tank 265 and the fourth tank 275 are fluidly coupled to the fifth heat exchanger 295; in particular, when the second closed-loop cycle arrangement in the second operating condition, the third valve 282 is in the open configuration and the fourth valve 284 is in the closed configuration. Preferably, when the third valve 282 is in the open configuration, the first closed-loop cycle arrangement is in the second operating condition.

In other words, the fifth heat exchanger 295 helps to exploit part the residual thermal capacity of the second working fluid downstream the expander 222, which is transferred to the second closed-loop cycle arrangement, in particular to the second heat-storage fluid, instead of being transferred by the fourth heat exchanger 241 to the fourth fluid stream, in particular to ambient air or water.

The invention claimed is:

1. A system for storing and using thermal energy, the system comprising:

a first heat-storage fluid;

a first closed-loop cycle arrangement comprising a first tank and a second tank for storing the first heat storage fluid, the first closed loop cycle arrangement having a first operating condition and a second operating condition;

a second thermodynamic cycle arrangement configured to heat the first heat-storage fluid flowing from the first tank to the second tank by consuming first electrical energy, the first electrical energy being input to the system, the second thermodynamic cycle arrangement comprising a first heat exchanger; and a third thermodynamic cycle arrangement configured to produce second electrical energy by cooling the first heat-storage fluid flowing from the second tank to the first tank, the second electrical energy being output from the system, the third thermodynamic cycle arrangement comprising a second heat exchanger, wherein in the first operating condition the first heat exchanger is fluidly coupled to the first tank and the second tank and the first heat-storage fluid flows from the first tank to the second tank, wherein in the second operating condition the second heat exchanger is fluidly coupled to the first tank and the second tank and the first heat-storage fluid flows from the second tank to the first tank, and wherein the second temperature is higher than the first temperature.

2. The system of claim 1, wherein the second thermodynamic cycle arrangement and the third thermodynamic cycle arrangement are fluidly coupled.

3. The system of claim 1, wherein the second thermodynamic cycle arrangement and the third thermodynamic cycle arrangement share the first heat exchanger and the second heat exchanger.

4. The system of claim 1, wherein the first heat exchanger is configured to transfer heat from the second thermodynamic cycle arrangement to the first closed-loop cycle arrangement in the first operating condition, and wherein the second heat exchanger is configured to transfer heat from the first closed-loop cycle arrangement to the third thermodynamic cycle arrangement in the second operating condition.

5. The system of claim 1, wherein the first heat exchanger is configured to flow a first fluid stream and to transfer heat from the third thermodynamic cycle arrangement to the first fluid stream in the second operating condition, and wherein the second heat exchanger is configured to flow a second fluid stream and to transfer heat from the second fluid stream to the second thermodynamic cycle arrangement in the first operating condition.

6. The system of claim 1, further comprising:

a third heat exchanger fluidly coupled to the second thermodynamic cycle arrangement; and a fourth heat exchanger fluidly coupled to the third thermodynamic cycle arrangement, wherein the third heat exchanger is fluidly coupled to a third fluid stream and is configured to transfer heat from the third fluid stream to the second closed-loop cycle arrangement in the first operating condition, and wherein the fourth heat exchanger is fluidly coupled to a fourth fluid stream and is configured to transfer heat from the third closed-loop cycle arrangement to the fourth fluid stream in the second operating condition.

7. The system of claim 1, wherein the first closed-loop cycle arrangement comprises further a first valve and a second valve, wherein the first valve and the second valve are configured to switch alternatively between an open configuration and a closed configuration, wherein the first valve is in the open configuration and the second valve is in the closed configuration in the first operating condition, and wherein the first valve is in the closed configuration and the second valve is in the open configuration in the second operating condition.

8. The system of claim 1, wherein the second thermodynamic cycle arrangement further comprises:

a compressor configured to increase pressure upstream of the heating of the heat-storage fluid; and a throttle valve configured decrease pressure downstream of the heating of the heat-storage fluid, wherein the compressor couples to an electric motor arranged to consume the first electrical energy and transform electrical energy into mechanical energy.

9. The system of claim 1, wherein the third thermodynamic cycle arrangement further comprises:

a pump configured to increase pressure downstream the cooling of the heat-storage fluid; and an expander configured to decrease pressure upstream the cooling of the heat-storage fluid, wherein the expander couples to an electric generator arranged to transform mechanical energy into electrical energy and to produce the second electrical energy.

10. The system of claim 1, further comprising: three-way valves arranged to switch the first closed-loop cycle arrangement between the first operating condition and the second operating condition.

11. The system of claim 1, further comprising:

three-way valves arranged to switch the first closed-loop cycle arrangement between the first operating condition and the second operating condition; and a heat unit configured to be fluidly coupled to the third heat exchanger, wherein the heat unit is configured to transfer heat to the third fluid stream in the first operating condition.

12. The system of claim 1, further comprising:

three-way valves arranged to switch the first closed-loop cycle arrangement between the first operating condition and the second operating condition, wherein the second closed loop cycle arrangement comprising a third tank and a fourth tank, wherein the third tank is arranged to store another heat-storage fluid at a third temperature, wherein the fourth tank is arranged to store another heat-storage fluid at a fourth temperature, the fourth temperature being higher than the third temperature, the fourth temperature being lower than the second temperature, wherein the second closed loop cycle arrangement has a third operating condition and a forth operating condition, wherein in the third operating condition, the first closed-loop cycle arrangement is configured to flow a second heat-storage fluid from the fourth tank to the third tank, wherein in the fourth operating condition, the first closed-loop arrangement flows a third heat-storage fluid from the third tank to the fourth tank, and wherein in the third operating condition, the third tank and the fourth tank are fluidly coupled to the third heat exchanger.

13. The system of claim 12, further comprising:

a fifth heat exchanger, wherein the fifth heat exchanger is configured to transfer heat from the third thermodynamic cycle arrangement to the second closed loop cycle arrangement, and wherein the third tank and the fourth tank are fluidly coupled to the fifth heat exchanger when the second closed-loop cycle arrangement is in the fourth operating condition.

* * * * *